United States Patent [19]

Gilbos

[11] 4,221,031

[45] Sep. 9, 1980

[54] DEVICE FOR DEPOSITION OF LOOPS OF YARN ON A CONVEYOR BELT OF A YARN PROCESSING CHAMBER

[75] Inventor: Georges E. Gilbos, Allst, Belgium

[73] Assignee: Textielmachinefabriek, Herdersem, Belgium

[21] Appl. No.: 935,239

[22] Filed: Aug. 21, 1978

[30] Foreign Application Priority Data

Sep. 1, 1977 [BE] Belgium ..... 256205
Sep. 30, 1977 [BE] Belgium ..... 858320

[51] Int. Cl.[2] ..... D02G 1/20; D02J 1/22
[52] U.S. Cl. ..... 28/281
[58] Field of Search ..... 226/118; 28/281, 289, 28/219; 242/47.01, 47.12, 83

[56] References Cited

U.S. PATENT DOCUMENTS

| | | | |
|---|---|---|---|
| 2,447,982 | 8/1948 | Koster | 226/97 |
| 3,430,312 | 3/1969 | Drummond | 28/289 |
| 3,469,798 | 9/1969 | Schroder | 242/83 |
| 3,491,561 | 1/1970 | Crump | 28/219 |
| 3,703,090 | 11/1972 | Rosen | 242/47.01 |
| 3,796,384 | 3/1974 | Rosen | 242/47.01 |
| 3,994,446 | 11/1976 | Jacobson | 242/47.01 |
| 4,109,357 | 8/1978 | Burow | 28/289 |

FOREIGN PATENT DOCUMENTS

| | | | |
|---|---|---|---|
| 1602027 | 11/1970 | France | 28/289 |

*Primary Examiner*—Edward J. McCarthy
*Attorney, Agent, or Firm*—William A. Drucker

[57] ABSTRACT

The invention pertains to a device for forming and depositing loops of yarn in such a manner on an endless belt conveyor which passes through a yarn processing chamber, that the loops partially overlap and lie sufficiently free to be able to undergo any sort of processing. This known processing of the yarn may, for instance, consist of a heat processing, for instance by means of steam under pressure.

5 Claims, 4 Drawing Figures

1
18
28
29
A
B
C
2
3
4
5
6
27

14
18
B
13
19
10
17
16
28
7
9
20
B
15
11
III
23
12
22
21
24
III
25
26
27
A
1
8

22
18
21
23
25
24

B
27

DEVICE FOR DEPOSITION OF LOOPS OF YARN ON A CONVEYOR BELT OF A YARN PROCESSING CHAMBER

DESCRIPTION

The new device according to the invention offers the advantage, that besides the fact that it is sturdy and operates dependably, the loops of yarn are laid on the conveyor belt straightway in the correct direction, so that it is no longer required, as with existing devices, to provide an extra device for turning over the loops of yarn, before the yarn can again be wound up after having been processed. With this new device the loops of yarn are deposited in such a manner on the conveyor belt that they slant slightly downward, in the direction of the movement of the conveyor belt, and partially overlapping each other, so that the uppermost loop can be lifted off without the slightest problem, for the purpose of rewinding the yarn after processing.

In order to attain this purpose, the device consists, according to the main characteristic of the invention, of the combination of a hollow shaft driven to rotate and having a side opening; an arm attached to this shaft and provided with a thread guiding eyelet; a stationary drum with cone shaped peripheral surface, the center line of which is along the extension of said hollow shaft, and upon which the yarn is wound via the hollow shaft, the side opening in this shaft and the thread guiding eyelet; a pressing-off disc, fitted on a slant with respect to the drum and cooperating with same; and a means for moving the disc with a wobbling motion so as to press off the wound up yarn from the peripheral surface of the drum in loops onto the conveyor belt.

According to another important characteristic of the invention, the device is installed at an angle and with the drum directed upward, along the extension of and close to the conveyor belt of the yarn processing chamber.

In consequence hereof, the loops of yarn are deposited in such a manner on the conveyor belt, that at the location of pick-up for rewinding, each loop is placed on top of the other loops and lies totally free, so that no difficulties occur during rewinding.

Merely as an example, and without the slightest intent at restriction, a more detailed description shall be given hereinafter of a preferred form of embodiment of the device according to the invention, with reference to the appended drawings in which.

Figure 1:
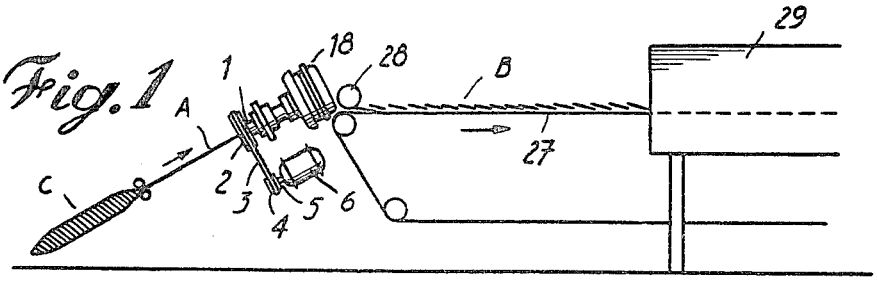
FIG. 1 shows a schematic side view of the device and of the yarn processing chamber.
Figure 2:
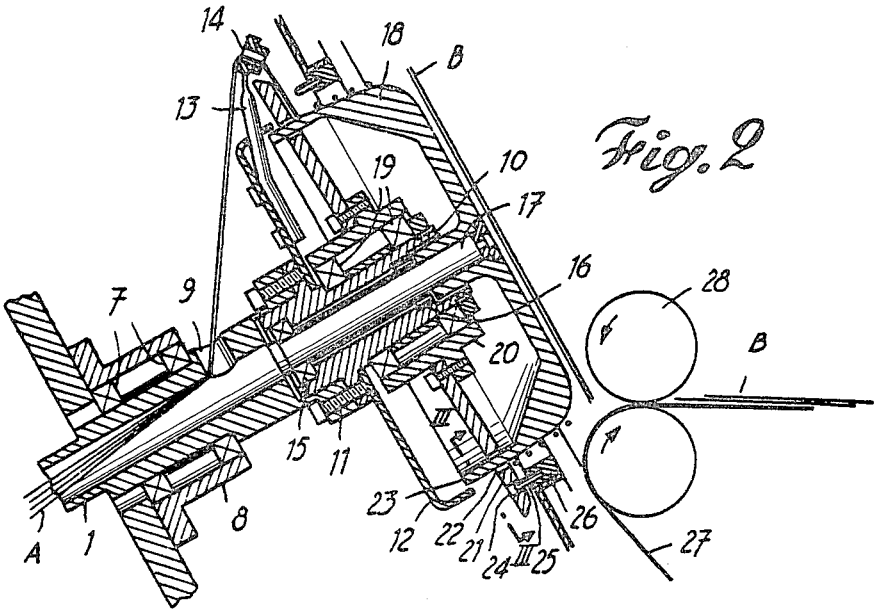
FIG. 2 shows an enlarged longitudinal section of the device for deposition loops of yarn.
Figure 3:
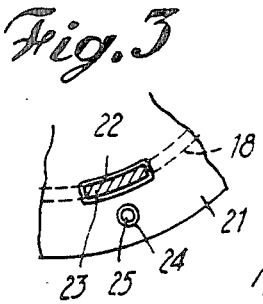
FIG. 3 shows a section according to line III—III in FIG. 2.

In these figures it can be seen that the device for depositing loops of yarn, comprises a hollow shaft 1 upon which is fixed a belt pulley 2 over which passes a belt 3 which also passes over a belt pulley 4 which is fixed upon the shaft 5 of an electric driving motor 6. The hollow shaft 1 is fitted in roller bearings 7 which are housed in a frame 8. In said shaft there is a side opening 9 through which the yarn A is guided outward, which is fed axially into the hollow shaft. The hollow shaft is provided with an extension 10 of which the peripheral surface forms an angle with respect to the center line of said shaft, and which is attached to same by means of bolts 11. Fixed to this extension 10 there is a circular cover plate 12, of which an arm 13 is an integral part which extends beyond said plate and which is provided with a yarn guiding eyelet 14 for guiding the yarn which comes out of the side opening 9 in hollow shaft 1. The equally hollow extension 10 is fitted by means of a bail bearing 15 and a needle bearing 16 upon a free shaft 17 to which is attached a cone shaped drum 18. A sleeve 20 is fitted by means of bail bearings 19 upon the slanting peripheral surface of extension 10, and upon this sleeve a disc 21 is fitted for the purpose of pressing the yarn off drum 18. This disc is provided towards its circumference with several slots 22 which fit over protruding teeth 23 of drum 18. Openings 24 are also provided towards the circumference of this disc, into which fit pins 25 which are solidly fixed in a ring 26 which itself is an integral part of frame 8. In order to eject the loops of yarn B in the correct direction from drum 18 onto the conveyor belt 27 of a yarn processing chamber, so that the rewinding of the yarn can be performed without trouble, the device for depositing the loops of yarn is located at an angle and with the drum pointing upward, in line with and close to conveyor belt 27. In order to deposit the yarn one loop at a time upon the conveyor belt, a counter roller 28 is fitted between the conveyor belt and the device for depositing the yarn.

Figure 4:
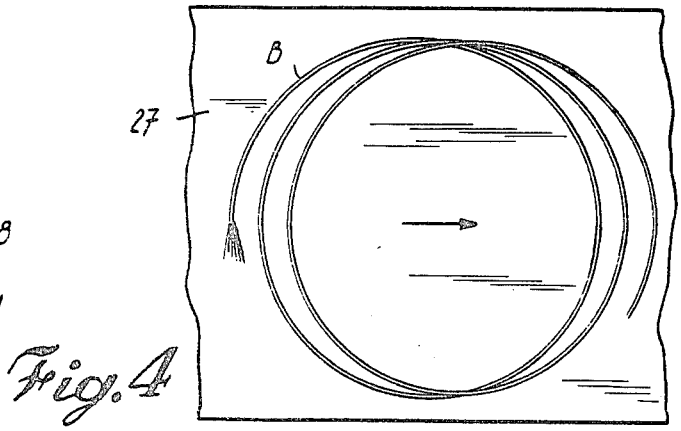
FIG. 4 shows a top view of the yarn deposited in loops onto the conveyor belt.

The operation of the device will be described hereinafter. The yarn A, supplied from several yarn bobbins C, is led via hollow shaft 1 and opening 9 to yarn guiding eyelet 14, from where the yarn is wound around drum 18. When motor 6 is started, the hollow shaft 1 will be driven in rotation in roller bearings 7, via belt pulleys 4-2 and driving belt 3. Extension 10 which is slantingly fitted upon said shaft is then driven so as to rotate together with arm 13 and yarn guiding eyelet 14. Hereby the yarn guiding eyelet 14, which rotates around the drum, lays the yarn A onto this drum. Pressure disc 21, which is fitted by means of roller bearings 19 upon the slanting extension 10 which is driven so as to rotate and which fits over the teeth 23 of drum 18, so that the latter can't rotate, thereby performs a wobbling motion so that the yarn is constantly pressed to the free end of cone shaped drum 18. The joint rotation of drum 18 and of pressing-off disc 21 is prevented by the pins 25 which are fitted in a fixed ring 26 and cooperate with openings 24 provided in disc 21 and by the teeth 23 of drum 18 which pass through slots 22 in disc 21. In consequence of the conically shaped peripherel surface area of drum 18, the yarn will fit less tightly around the free end of the drum, so that the loops of yarn can easily be pressed off the drum by pressing-off disc 21. The counter roller 28, which is fitted between the device and conveyor belt 27, deposits the yarn one loop at a time on conveyor belt 27 which subsequently feeds the yarn into the yarn processing chamber 29, which may be used for any desired purpose whatever. This chamber may for instance be intended for the steam processing of yarn, but might just as well be intended for the processing of any other sort of objects. The loops of yarn ejected by means of this device are thus immediately deposited in the correct sense onto the conveyor belt (FIG. 4) in other words, at the spot where the yarn will be picked up again in order to be rewound, and each loop of yarn lies entirely free on top of the remaining loops of yarn. It consequently is no longer necessary, as used to be the case with the previously known devices, to turn about the loops of yarn, either before or after the processing, so as to permit the rewinding of the yarn, for instance by means of a cross spooling machine, without running into trouble.

It is quite obvious that the shape and the dimensions of the parts described above may vary, that some of the parts described above could be replaced by others which fulfill the same purpose, and that the mutual fitting of the parts described above may also vary, without going beyond the scope of the present invention.

I claim:

1. A device, for depositing loops of yarn on an endless belt conveyor which passes through a yarn processing chamber, comprising a support structure, a hollow shaft rotatably mounted in said structure and having a side opening, an arm attached to said shaft and carrying a yarn guiding eyelet, a stationary drum having a conical peripheral surface area of which the center line lies along the extension of said hollow shaft and upon which the yarn is wound after passing through the hollow shaft and the side opening in the shaft and the thread guiding eyelet, an annular pressing off element encircling the drum closely adjacent to said surface area, and means for moving the pressing off element with a wobbling motion in order to press loops of yarn, wound on the peripheral surface of the drum, axially off the drum.

2. A device, as claimed in claim 1, in which said means for moving the pressing off element with a wobbling motion comprises an extension of said hollow shaft forming an angle with respect to said shaft and freely rotatable in said pressing off element, and means for preventing rotation of the pressing off element relative to the drum.

3. A device, as claimed in claim 1, in which the drum is provided with a shaft over which the hollow shaft is driven in rotation, means being provided between said structure and the pressing off element to prevent the pressing off element from rotating, and means being provided between the pressing off element and the drum to prevent the drum from rotating.

4. A device as claimed in claim 1, in combination with a conveyor belt of a yarn processing chamber, said device being mounted with its drum having its axis directed at an inclination upwardly, and in line with and close to said conveyor belt.

5. The combination claimed in claim 4 further comprising a counter roller disposed between said device and said conveyor belt to deposit the yarn one loop at a time on said conveyor belt.

* * * * *

UNITED STATES PATENT AND TRADEMARK OFFICE

CERTIFICATE OF CORRECTION

PATENT NO. : 4,221,031

DATED : September 9, 1980

INVENTOR(S) : Georges E. Gilbos

It is certified that error appears in the above—identified patent and that said Letters Patent is hereby corrected as shown below:

(73) Assignee: Textielmachinefabriek Gilbos N.V.
Herdersem, Belgium

(30) Foreign Application Priority Data:

Sept. 1, 1977 (BE) Belgium.....256205

Signed and Sealed this

*Twenty-sixth* Day of *May 1981*

[SEAL]

*Attest:*

RENE D. TEGTMEYER

*Attesting Officer*

*Acting Commissioner of Patents and Trademarks*